US005129442A

United States Patent [19]

Warner

[11] Patent Number: 5,129,442

[45] Date of Patent: Jul. 14, 1992

[54] ROLL-UP INDUSTRIAL DOOR HAVING A COMBINED PULLEY FOR COUNTERWEIGHT AND SPRING TENSION BELTS

[75] Inventor: Robert J. Warner, Mukwonago, Wis.

[73] Assignee: Kelley Company Inc., Milwaukee, Wis.

[21] Appl. No.: 814,001

[22] Filed: Dec. 26, 1991

[51] Int. Cl.[5] ..... E06B 9/56

[52] U.S. Cl. ..... 160/271; 160/310; 160/265

[58] Field of Search ..... 160/310, 265, 322, 201, 160/133, 7, 8, 1, 188, 271

[56] References Cited

U.S. PATENT DOCUMENTS

| | | | |
|---|---|---|---|
| 490,448 | 1/1893 | Lugrin . | |
| 3,299,570 | 1/1967 | Radcliffe . | |
| 3,462,885 | 8/1969 | Miller . | |
| 3,582,998 | 6/1971 | Morse . | |
| 3,878,879 | 4/1975 | Manns | 160/273.1 |
| 3,981,343 | 9/1976 | DeVito | 160/190 X |
| 4,133,365 | 1/1979 | Schleicher | 160/118 |
| 4,373,602 | 2/1983 | Tomita et al. | 180/227 |
| 4,452,292 | 6/1984 | Leivenzon et al. | 160/133 |
| 4,570,437 | 2/1986 | Moritz | 59/78.1 |
| 4,690,194 | 9/1987 | Seuster | 160/265 |
| 4,770,224 | 9/1988 | Dubbelman | 160/331 |
| 4,834,160 | 5/1989 | Becker | 160/66 |
| 5,048,588 | 9/1991 | Weishar | 160/265 |

FOREIGN PATENT DOCUMENTS

| | | |
|---|---|---|
| 2556403 | 6/1985 | France . |
| 1444017 | 7/1976 | United Kingdom . |

*Primary Examiner*—Blair M. Johnson

*Attorney, Agent, or Firm*—Andrus, Sceales, Starke & Sawall

[57] ABSTRACT

A roll-up door for enclosing the doorway in a building. The door comprises a horizontal rotatable drum mounted above the doorway and a flexible door panel is wound on the drum. A pulley is secured to each end of the drum and the first ends of a pair of belts are secured to each pulley and the belts are wound in overlapping relation on pulley so that adjacent convolutions of each belt are separated by convolutions of the other belt. The free end of one belt is dead-ended on the frame, and a counterbalancing weight is attached to the belt intermediate its ends and exerts a counterbalancing force to wind the door panel on the drum. The free end of the second belt is connected to the lower end of the door panel and a pair of springs are connected to the second belt intermediate its ends and the springs exert a tensioning force to stretch the door panel when the door panel is in the closed position.

15 Claims, 2 Drawing Sheets

FIG. 3
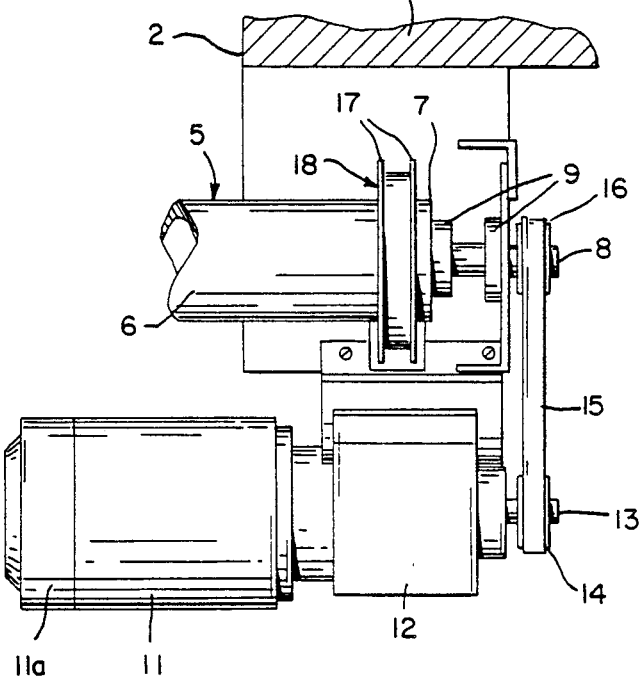
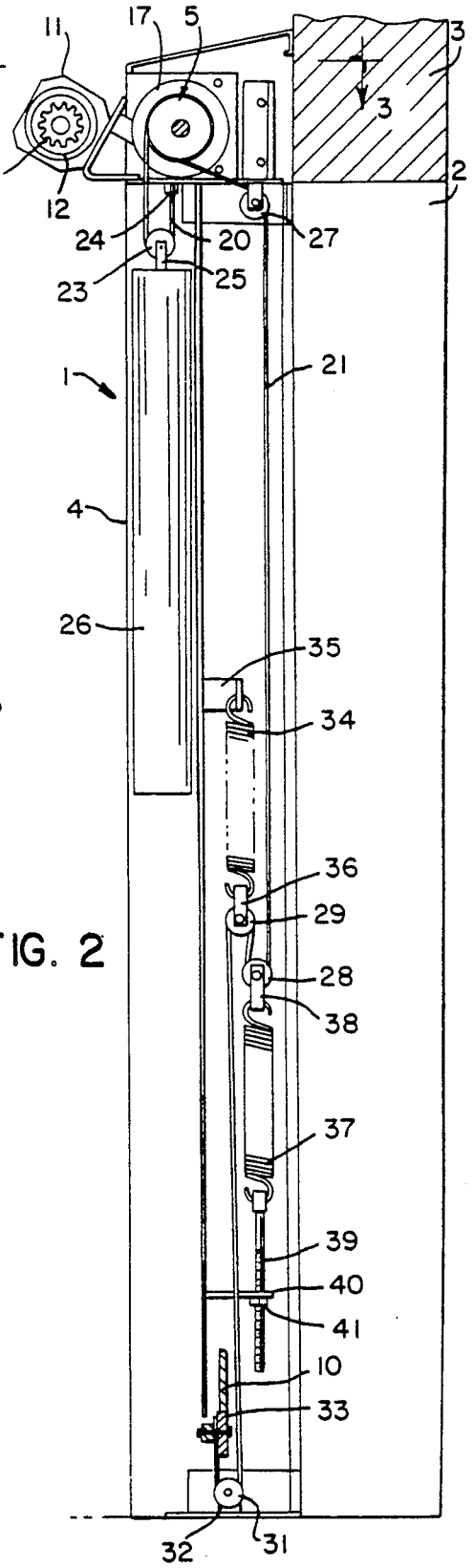
FIG. 2
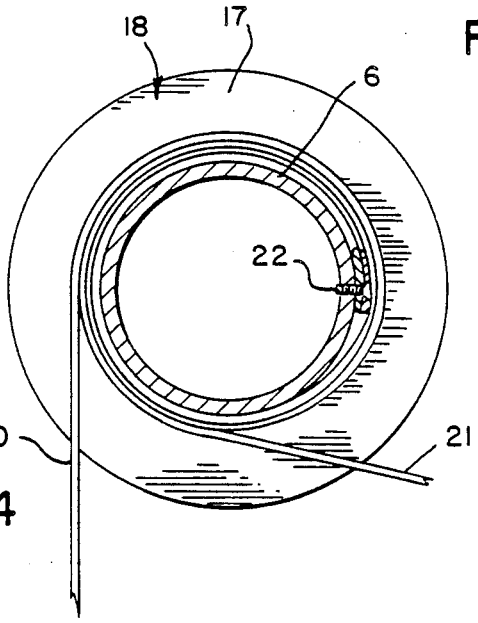
FIG. 4

ROLL-UP INDUSTRIAL DOOR HAVING A COMBINED PULLEY FOR COUNTERWEIGHT AND SPRING TENSION BELTS

BACKGROUND OF THE INVENTION

Roll-up doors are used in industrial or commercial establishments to separate different areas of a building, or to separate the inside of a building from the exterior. For example, roll-up doors may be used to separate two areas or zones which have different temperature or humidity conditions or to provide noise control between two areas. A roll-up door has the advantage of being capable of being moved rapidly between the open and closed positions, and when in the open position, the door panel is wound on a drum located above the doorway, so that the door panel will not obstruct the doorway.

U.S. Pat. No. 3,878,879 describes a roll-up door incorporating a counterbalancing system. In that patent, a drum is mounted above the doorway and a flexible door panel is wound on the drum. A pulley is secured to each end of the drum and one end of a cable is secured to the pulley, while the opposite end of the cable is connected to the bottom of the door panel. Secured to each cable intermediate its ends is a weight which serves to counterbalance the weight of the door panel. If additional tensioning is required for the door panel, when in the closed position to prevent wind deflection, it is necessary to add additional counterweight. However, added counterweight cannot be easily implemented and requires increased driving force to move the door panel to the closed position.

U.S. Pat. No. 5,048,588 is directed to a roll-up door incorporating a counterbalancing mechanism and a separate spring tensioning mechanism. In accordance with that patent, a pair of pulleys are secured to each end of the drum and one end of a first belt is secured to a first of each pair of pulleys, while the opposite end of the belt is dead-ended on the frame of the door. A counterbalancing mechanism, such as a counterweight, is attached to the belt intermediate its ends and exerts a rotational force on the drum in a direction to wind the door panel on the drum.

In addition, one end of a second belt is secured to a second of each pair of pulleys and the opposite end of each second belt is connected to the lower end of the door panel. A resilient member, such as a spring, is connected to each second belt intermediate its ends and exerts a force on the door panel to stretch the door panel at all positions. The force of the spring can be adjusted to regulate the tensioning of the door panel. With the construction of the aforementioned patent, the door panel tensioning system is separate from the counterbalancing system, so that the tension on the door panel can be controlled without affecting the counterbalancing.

SUMMARY OF THE INVENTION

The invention is directed to an improved roll-up door having a combined pulley for the counterweight and spring tensioning systems.

In accordance with the invention, a rotatable horizontal drum is mounted above the doorway in a building, and can be driven in a reversible manner by a drive unit, such as a hydraulic motor. A pair of annular plates are secured in spaced relation on each end of the drum, and each pair of plates defines a pulley. The first ends of a pair of belts are secured to each pulley, and the belts are wound in a series of overlapping convolutions on each pulley, so that adjacent convolutions of each belt are separated by convolutions of the other belt.

The free end of one of the belts of each pair is dead-ended on the frame of the door and a counterbalancing weight is attached to the belt intermediate its ends and exerts a rotational force on the drum in a direction to wind the door panel on the drum.

In addition, the free end of a second belt of each pair is connected to the lower end of the door panel and a pair of resilient members, such as springs, are interconnected to each second belt intermediate its ends and exert a force on the door panel to stretch or tension the door panel at all positions. An adjustment is provided to adjust the force of the springs to regulate the tensioning of the door panel. The tensioning springs act to resist wind deflection of the door panel when the door panel is being unrolled, or when it is in the fully unrolled and closed condition.

By winding both belts on a single pulley, a substantial cost savings is achieved. In addition, the invention provides a more compact unit, as compared to conventional roll-up doors which require a pair of pulleys at each end of the drum to individually support the counterbalancing and spring tensioning belts.

Even though the two belts are wound on a single pulley, the door panel tensioning system is separate from the counterbalancing system, so that the tension on the door panel can be controlled without effecting the counterbalancing system.

Other objects and advantages will appear in the course of the following description.

DESCRIPTION OF THE DRAWINGS

The drawings illustrate the best mode presently contemplated of carrying out the invention.

In the drawings:

FIG. 2 is an end view of the door with parts broken away in section;

FIG. 3 is a section taken along line 3—3 of FIG. 2; and

FIG. 4 is an enlarged section taken along line 4—4 of FIG. 1.

DESCRIPTION OF THE ILLUSTRATED EMBODIMENT

Figure 1:
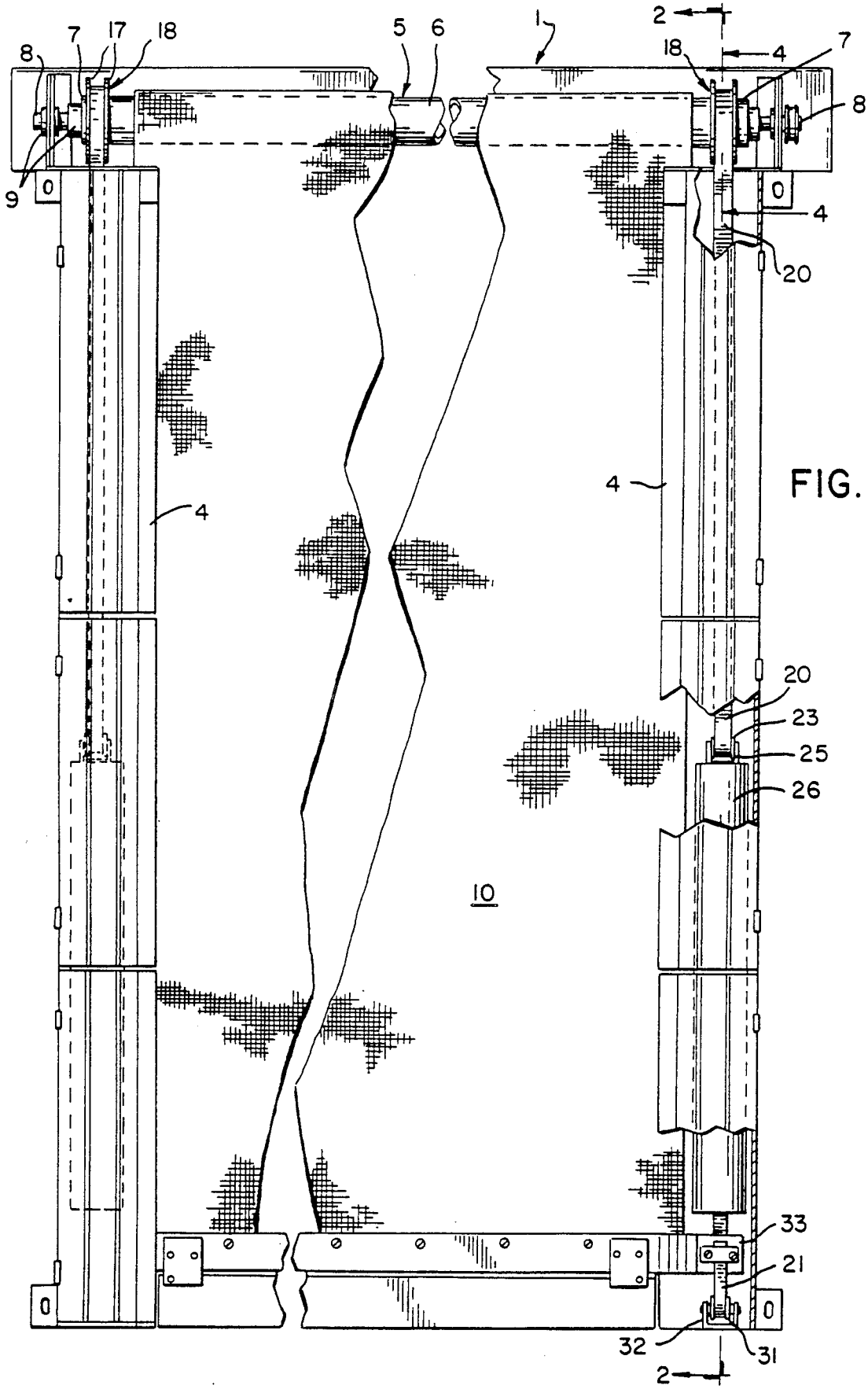
FIG. 1 is a front elevation of the roll-up door of the invention with parts broken away in section and showing the door panel in the closed or unrolled condition.

The drawings illustrate an industrial roll-up door 1 which is adapted to enclose a doorway 2 in a commercial or industrial building 3. Door 1 includes a pair of generally box-shaped vertical frames 4 which are located along the sides of the doorway 2. A cylindrical drum 5 is mounted horizontally above doorway 2, and drum 5 is composed of a hollow cylinder 6, the ends of which are closed off by end plates 7. Shafts 8 project outwardly from each end plate 7 and are journaled for rotation in bearings 9 which are supported on the upper ends of frame member 4.

A flexible door panel 10 has one end secured to the outer surface of drum 5 and is adapted to be wound and unwound from the drum. In the unwound condition, panel 10 extends downwardly and will enclose the doorway, as shown in FIG. 1. Door panel 10 is preferably formed of fabric and is coated with a plastic material, such as polyvinylchloride, or the like.

To rotate drum 5 and thereby roll and unroll the door panel 10, an electric motor 11 is connected to one of the shafts 8 through a gear box 12. In this regard, the output shaft 13 of gear box 12 carries a timing pulley 14 that is connected via timing belt 15 to a timing pulley 16 on shaft 8, as illustrated in FIG. 3. Operation of motor 11 in one direction will cause the panel 10 to unwind from the drum, while rotation of the motor in the opposite direction will wind the panel on the drum. A motor mounted brake 11*a* is constructed so that it will be in a disengaged condition when the motor is operating and will automatically be engaged when operation of the motor is terminated, so that the brake will then hold the door panel in any given position.

In accordance with the invention, a pair of annular plates 17 are secured in spaced relation to each end of drum 5 and each pair of plates 17 defines a pulley 18.

A pair of belts 20 and 21 are wound in overlapping convolutions on each pulley 18. Each belt 20,21 has a greater width than thickness and the width of each belt is slightly less than the distance between the end plates 17 of pulley 18.

As shown in FIG. 4, the corresponding inner ends of belts 20 and 21 are secured to the outer surface of cylinder 6 through a suitable connector or fastener 22, and the belts 20 and 21 are then wound on each pulley 18 in a manner such that the adjacent convolutions or turns of each belt are separated by convolutions of the other belt.

As shown in FIG. 2, each belt 20 extends tangentially from the respective pulley 18 and passes downwardly around pulley 23 and then upwardly and is dead-ended at 24 on frame 4. Pulley 23 is mounted for rotation on a bifurcated bracket 25 and the lower end of the bracket 25 is connected to an elongated counterbalancing weight 26, which is housed within the respective frame 4.

Weight 26 exerts a force on belt 20, tending to rotate pulley 18 and drum 5 in a direction to roll the door panel on the drum and thus serves to counterbalance the weight of the door panel. As the door panel 10 is wound on drum 5, counterweight 26 will move downwardly within the frame 4, and movement of the counterweight can be guided by suitable guides, not shown, attached to the frames 4.

The second belt 21 wound on each pulley 18 is connected to a spring tensioning system. As shown in FIG. 4, each belt 21 extends tangentially from each pulley 18 at a point of tangency which is located approximately 90° from the point of tangency where the belt 20 leaves the pulley 18.

As seen in FIG. 2, each belt 21 passes over a pulley 27, which is mounted for rotation on the upper end of frame 4, then passes downwardly around pulley 28 and upwardly around pulley 29. Each belt 21 then extends downwardly and passes around a pulley 31, which is journaled in a bracket 32 mounted on the base of frame 4 and the belt is then dead-ended on the projecting end of a rigid horizontal beam 33 which is connected to the lower end of door panel 10.

As best shown in FIG. 2, an extension spring 34 is connected between a bracket 35 on frame 4 and a bracket 36 that supports pulley 29, while a second extension spring 37 is connected between a bracket 38 that carries pulley 28, and an adjustable rod 39. The lower end of rod 39 extends through an opening in a fixed plate 40, which is attached to frame 4, and the lower end of the rod is threaded to a nut 41. By threaded adjustment of nut 41, the force of the springs can be varied, to thereby control the tensioning force on door panel 10. With this arrangement, the springs 34 and 37 exert a downward force through belts 21 on the door panel 10 when it is in the unrolled condition to stretch the door panel and resist wind deflection.

By winding both belts 20 and 21 on a single pulley 18, a substantial cost savings is achieved over a conventional unit using side-by-side pulleys for the individual belts. Further, the invention provides a more compact unit than a system utilizing side-by-side pulleys.

Even though the belts 20 and 21 are wound on a single pulley, the tensioning system is separate from the counterbalancing system, so that the tension on the door panel can be controlled without effecting the counterbalancing.

While the above description has shown the drum 5 being driven by motor 11, it is contemplated that the invention can also be utilized with a manually operated roll-up door which does not employ a motor or power source.

Various modes of carrying out the invention are contemplated as being within the scope of the following claims particularly pointing out and distinctly claiming the subject matter which is regarded as the invention.

I claim:

1. A roll-up door construction for enclosing a doorway in a building, comprising rotatable drum means mounted on the building above the doorway, a flexible door panel disposed to be wound on said drum means and adapted to be moved between a rolled-up open position and an unrolled closed position, a first belt having a first end secured to said drum and wound on said drum in a plurality of overlapping convolutions, a second belt having a first end secured to said drum and wound in a plurality of overlapping convolutions, said belts disposed in a common vertical plane and each convolution of said first belt being separated from adjacent convolutions of said first belt by convolutions of said second belt, counterbalancing means attached to said first belt intermediate the ends thereof for exerting a rotational force on said drum means to urge said door panel to the open position, and resilient means connected to said second belt for exerting a downward biasing force on said door panel when said door panel is in the closed position.

2. The construction of claim 1, wherein each belt has a greater width than thickness.

3. The construction of claim 1, wherein said drum means includes a pulley, both of said belts being wound on said pulley.

4. The construction of claim 1, wherein a portion of said first belt located between said first end and the attachment of the counterbalancing means to said first belt extends tangentially to said drum means at a first point of tangency, a portion of said second belt located between the first end of said second belt and the attachment of said resilient means extending tangentially to said drum means at a second point of tangency, said second point of tangency being less than 180° from said first point of tangency.

5. The construction of claim 4, wherein said second point of tangency is located approximately 90° from said first point of tangency.

6. The construction of claim 1, wherein said resilient means comprises a spring.

7. The construction of claim 1, wherein said counterbalancing means comprises a counterbalancing weight.

8. The construction of claim 1, and including a rigid beam connected to the lower end of said door panel, a second end of said second belt being connected to said beam.

9. A roll-up door construction for enclosing a doorway in a building, comprising a cylindrical drum mounted on the building above the doorway, a pair of annular plates secured in spaced relation to the outer surface of said drum and defining a pulley, a flexible door panel disposed to be wound on said drum and adapted to be moved between a rolled-up open position and an unrolled closed position, a pair of belts each wound in a plurality of overlapping convolutions on said pulley, the convolutions of a first of said belts being separated from adjacent convolutions of said first belt by convolutions of said second belt, each belt having a greater width than thickness, counterbalancing means attached to said first belt for exerting a rotational force on said drum to urge the door panel to the open position, and resilient means connected to said second belt for exerting a downward biasing force on said door panel when the door panel is in the closed position.

10. The construction of claim 9, wherein each belt has a width slightly less than the spacing between said plates.

11. The construction of claim 9, wherein the inner ends of the belts are connected to the same location on the drum.

12. A roll-up door construction for enclosing a doorway in a building, comprising a cylindrical rotatable drum mounted on the building above the doorway, a flexible door panel disposed to be wound on said drum and adapted to be moved between a rolled-up open position and an unrolled closed position, a pulley connected to each end of the drum, a pair of belts each having an inner end connected to the pulley and each belt being wound in a plurality of overlapping convolutions on said pulley, each convolution of one of said belts being separated from adjacent convolutions of said one belt by the convolutions of the other belt, counterbalancing means attached to a first of said belts intermediate the ends thereof for exerting a rotational force on the drum to urge said door panel to the open position, and resilient means connected to a second of said belts intermediate the ends thereof for exerting a downward biasing force on the door panel when the door panel is in the closed position.

13. The construction of claim 12, and including a pair of second pulleys associated with each second belt and constructed and arranged to divide the force exerted by said resilient means into two opposite load components.

14. The construction of claim 13, and including adjustment means for adjusting the force of said resilient means.

15. The construction of claim 12, and including drive means operably connected to said drum for rotating the drum to thereby move the door panel between the open and closed positions.

* * * * *